US007836902B2

(12) United States Patent
Tung

(10) Patent No.: US 7,836,902 B2
(45) Date of Patent: Nov. 23, 2010

(54) SUNSHADE HAVING BASE

(76) Inventor: Benson Tung, No. 587, Chiengong Rd., Kaohsiung (TW)

( * ) Notice: Subject to any disclaimer, the term of this patent is extended or adjusted under 35 U.S.C. 154(b) by 66 days.

(21) Appl. No.: 12/372,807

(22) Filed: Feb. 18, 2009

(65) Prior Publication Data

US 2010/0206346 A1 Aug. 19, 2010

(51) Int. Cl.
*A45B 11/00* (2006.01)

(52) U.S. Cl. ..... 135/20.3; 248/521

(58) Field of Classification Search ..... 135/20.3; 248/519, 521

See application file for complete search history.

(56) References Cited

U.S. PATENT DOCUMENTS

| | | | | |
|---|---|---|---|---|
| 4,586,525 | A | 5/1986 | Glatz et al. | 135/20 |
| 6,152,156 | A | 11/2000 | Tung | 135/21 |
| 6,488,254 | B2 * | 12/2002 | Li | 248/521 |
| 6,511,033 | B2 * | 1/2003 | Li | 248/519 |
| 6,637,717 | B2 * | 10/2003 | Li | 248/519 |
| 7,028,968 | B2 * | 4/2006 | Washick | 248/521 |
| 2008/0111046 | A1 * | 5/2008 | Tung | 248/521 |
| 2008/0296463 | A1 * | 12/2008 | Li | 248/519 |

* cited by examiner

*Primary Examiner*—David Dunn
*Assistant Examiner*—Noah Chandler Hawk
(74) *Attorney, Agent, or Firm*—Alan Kamrath; Kamrath & Associates PA

(57) ABSTRACT

A sunshade includes a coupling seat mounted to a top face of a base. A gear is rotatably received in the coupling seat and includes a plurality of positioning grooves spaced in a circumferential direction. A supporting rod for supporting a canopy is fixed to the gear. An operative member includes an end pivotably coupled to the coupling seat. A pawl extends from the end of the operative member. The other end of the operative member is operable to move the operative member between a coupling position releasably engaged in one of the positioning grooves of the gear to fix the gear relative to the coupling seat and a release position disengaged from the positioning grooves with the supporting rod and the gear rotatable relative to the base about a vertical axis perpendicular to the circumferential direction, allowing adjustment of an angular position of the canopy relative to the base.

7 Claims, 6 Drawing Sheets

SUNSHADE HAVING BASE

BACKGROUND OF THE INVENTION

The present invention relates to a sunshade having a base and, more particularly, to a sunshade having a base and a supporting rod rotatable relative to the base.

A sunshade or large umbrella generally includes a supporting rod and a foldable canopy. The supporting rod can be mounted to a base to provide convenient use. Furthermore, an adjusting mechanism can be provided between the supporting rod and the canopy so that the tilting angle of the canopy relative to the supporting rod can be adjusted. However, the angular position of the canopy relative to the supporting rod can only be adjusted by rotating the supporting rod together with the base that is bulky and, thus, difficult to move.

In an approach to avoid troublesome and laborious operation of the supporting rod and the base, a sleeve is mounted to a lower end of the supporting rod that is inserted into an anchoring sleeve secured in a base or a floor. A detent device is provided to fix the supporting rod in different angular positions and to secure the supporting rod against undesired removal from the anchoring sleeve. The detent device includes a pawl lever extending through an opening in a peripheral wall of the sleeve. The pawl lever includes a pawl pin extending through another opening of the sleeve and releasably engaged with one of a plurality of pawl recesses spaced from one another along a circumference of the anchoring sleeve. The supporting rod can be rotated without moving the base when the pawl pin is disengaged from the pawl recesses by operating the pawl lever. However, the supporting strength for supporting rod is adversely affected by the openings of the sleeve and the pawl recesses of the anchoring sleeve. In an approach to avoid troublesome and laborious operation of the supporting rod and the base, a sleeve is mounted to a lower end of the supporting rod that is inserted into an anchoring sleeve secured in a base or a floor. A detect device is provided to fix the supporting rod in different angular positions and to secure the supporting rod against undesired removal from the anchoring sleeve. The detent device includes a pawl lever extending through an opening in a peripheral wall of the sleeve. The pawl lever includes a pawl pin extending through another opening of the sleeve and releasably engaged with one of a plurality of pawl recesses spaced from one another along a circumference of the anchoring sleeve. The supporting rod can be rotated without moving the base when the pawl pin is disengaged from the pawl recesses by operating the pawl lever. However, the supporting strength for the supporting rod is adversely affected by the openings of the sleeve and the pawl recesses of the anchoring sleeve.

Thus, a need exists for a sunshade or large umbrella having a supporting rod that can be adjusted in an angular position relative to the base without adversely affecting the supporting strength for the supporting rod.

BRIEF SUMMARY OF THE INVENTION

The present invention solves this need and other problems in the field of rotatable sunshades by providing, in a preferred form, a sunshade including a base and a coupling seat mounted to a top face of the base. A gear is rotatably received in the coupling seat and includes an outer periphery having a plurality of positioning grooves spaced in a circumferential direction. A supporting rod adapted for supporting a canopy is fixed to the gear. The supporting rod and the gear are rotatable relative to the base about a vertical axis perpendicular to the circumferential direction. An operative member includes a first end pivotably coupled to the coupling seat and a second end. A pawl extends from the first end of the operative member. The second end of the operative member is operable to pivot the operative member to move the pawl between a coupling position releasably engaged in one of the positioning grooves of the gear to fix the gear relative to the coupling seat and a release position disengaged from the positioning grooves with the supporting rod and the gear rotatable relative to the base about the vertical axis, allowing adjustment of an angular position of the canopy relative to the base.

In the most preferred form, the gear includes upper and lower faces spaced along the vertical axis. A hub is formed on the lower face of the gear. The coupling seat includes upper and lower surfaces spaced along the vertical axis. The upper surface of the coupling seat includes a recess rotatably receiving the gear. The lower surface of the coupling seat includes a groove separate from the recess along the vertical axis by a bottom wall. A through-hole extends through the bottom wall and is in communication with the groove and the recess. A bearing is received in the groove. The hub of the gear rotatably extends through the through-hole of the coupling seat into the bearing.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
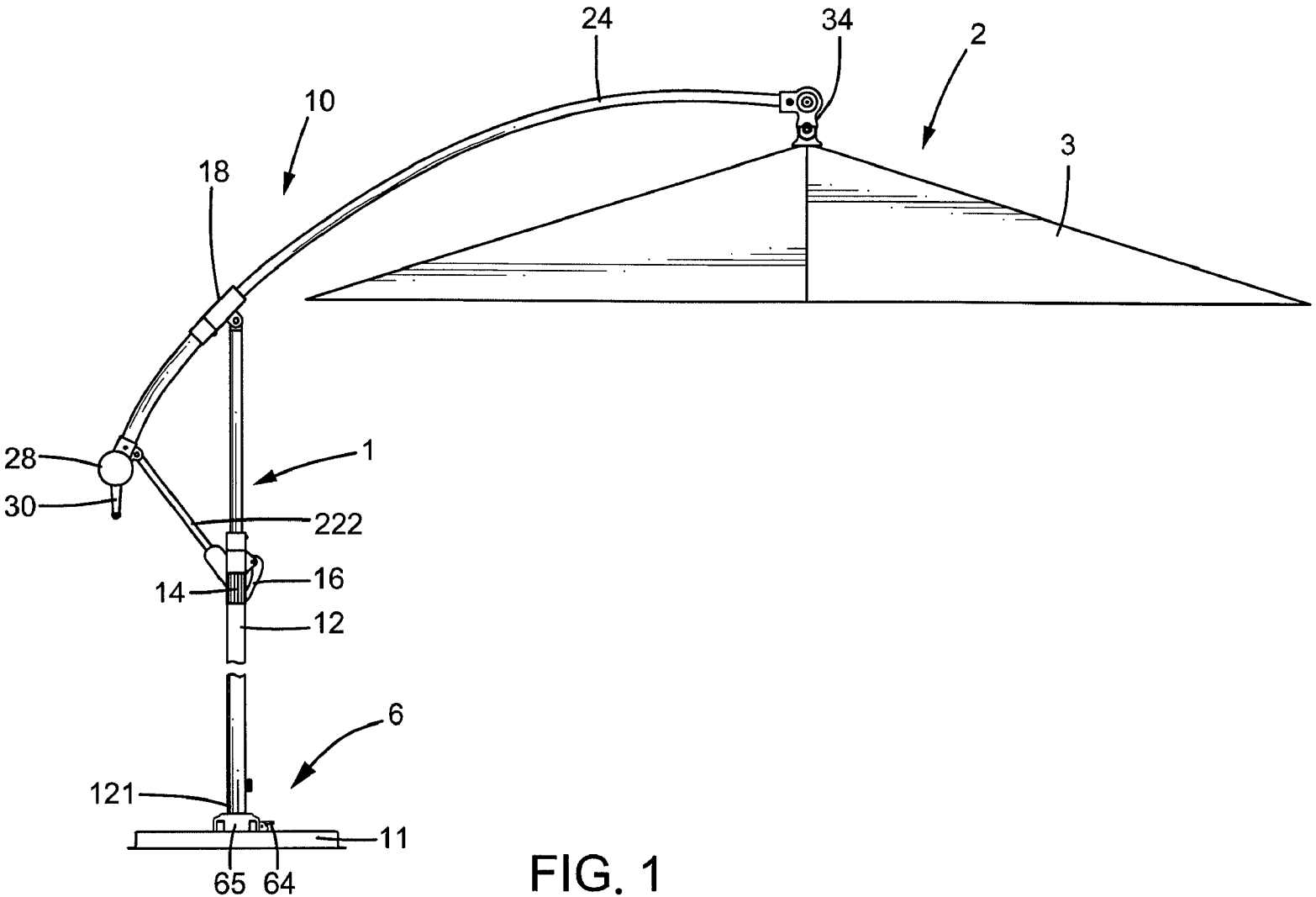
FIG. 1 shows a diagrammatic side view of a sunshade according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "end", "axial", "radial", "circumferential", "vertical", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A sunshade according to the preferred teachings of the present invention is shown in the drawings and generally designated 10. According to the preferred form shown, sunshade 10 includes a main frame 1 having a supporting rod 12 extending along a vertical axis. An adjusting sleeve 14 is slideably mounted on supporting rod 12. A lever 16 is mounted to adjusting sleeve 14 and pivotable between a locking position retaining adjusting sleeve 14 on supporting rod 12 and a released position allowing sliding movement of adjusting sleeve 14 along the vertical axis. A holding sleeve 18 is pivotably mounted to an upper end of supporting rod 12. An arcuate tube 24 is slideably held by holding sleeve 18. A reel 28 is mounted to a lower end of arcuate tube 24 and includes a handle 30. An elbow 34 is mounted to an upper end of arcuate tube 24. A canopy support frame 2 is coupled to elbow 34 and supports a canopy 3. At least one connecting rod 222 is coupled between adjusting sleeve 14 and the lower end of arcuate tube 24. A cable is received in arcuate tube 24 and includes a first end coupled to handle 30 and a second end coupled to canopy support frame 2. When the handle 30 is operated, canopy 3 can be folded or unfolded. When adjustment of a tilting angle of canopy 3 is required, lever 16 is moved to the released position to allow adjusting sleeve 14 to move along supporting rod 12, and arcuate tube 24 slides along holding sleeve 18 until a desired tiling angle of canopy 3 is obtained. Lever 16 is then moved to the locking position. Such a sunshade is disclosed in U.S. Pat. No. 6,152,156, the entire contents of which are incorporated herein by reference. However, sunshade 10 according to the preferred teachings of the present invention can be of other forms as conventional including but not limited to a commercially available type. For example, sunshade 10 can include supporting rod 12, canopy support frame 2 directly mounted on the upper end of supporting rod 12, and canopy 3 mounted on canopy support frame 2.

According to the preferred form shown, sunshade 10 further includes a base 11 and an adjusting device 6 mounted to a top face of base 11 and coupled to supporting rod 12, so that supporting rod 12 can rotate to a desired angular position relative to base 11. Specifically, adjusting device 6 includes a coupling seat 61 mounted to the top face of base 11. In the most preferred form shown, coupling seat 61 includes an outer periphery having a plurality of ears each having a screw hole 610. Screws 616 are extended through screw holes 610 into the top face of base 11 to fix coupling seat 61 to base 11. Coupling seat 61 further includes two lugs 614 extending outward from the outer periphery with a spacing 602 formed between lugs 614. Lugs 614 are spaced in a direction perpendicular to the vertical axis and have aligned pin holes 615. Coupling seat 61 further includes an upper surface 617 and a lower surface 619 separate from upper surface 617 along the vertical axis. Upper surface 617 of coupling seat 61 includes a recess 612. Lower surface 619 of coupling seat 61 includes a groove 613 spaced from recess 612 along the vertical axis by a bottom wall 618. A through-hole 611 extends through bottom wall 618 and is in communication with groove 613 and recess 612. A bearing 66 is received in groove 613 and has an axial bore 661 coaxial with through-hole 611.

According to the preferred form shown, adjusting device 6 further includes a gear 62 rotatably received in recess 612. Gear 62 includes upper and lower faces 626 and 628 spaced along the vertical axis. A hub 622 is formed on lower face 628 of gear 62 and rotatably extends through through-hole 616 of coupling seat 61 into bearing 66. Hub 622 has a screw hole 623 extending along the vertical axis. Gear 62 further includes an outer periphery extending between upper and lower faces 626 and 628 and having a plurality of positioning grooves 625 spaced in a circumferential direction perpendicular to the vertical axis. In the most preferred form shown, the outer periphery of gear 62 includes a plurality of teeth 624 with each positioning groove 625 formed between two adjacent teeth 624. Furthermore, each positioning groove 625 has increasing widths toward upper face 626. A washer 662 is mounted to a lower face of bearing 66. A screw 663 is extended through washer 662 and axial bore 661 of bearing 661 into screw hole 623 of hub 622 of gear 62. A lid 664 is fixed by screws 665 to lower surface 619 of coupling seat 61 to cover groove 613 of coupling seat 61 and to support bearing 66.

According to the preferred form shown, adjusting device 6 further includes a connecting tube 63 for connecting gear 62 to supporting rod 12. Specifically, supporting rod 12 includes a radial hole 122 extending in a radial direction perpendicular to the vertical axis. Connecting tube 63 includes upper and lower ends 633 and 634 spaced along the vertical axis. Upper end 633 of connecting tube 63 is received in supporting rod 12 and has a radial hole 635 aligned with radial hole 122 of supporting rod 12. A flange 631 is formed on lower end 634 of connecting tube 63 and fixed by screws 632 to upper face 626 of gear 62. A fastener 13 is extended through radial holes 122 and 635 to secure supporting rod 12 and connecting tube 63 together. Thus, supporting rod 12 and gear 62 can rotate jointly about the vertical axis relative to base 11.

Figure 3:
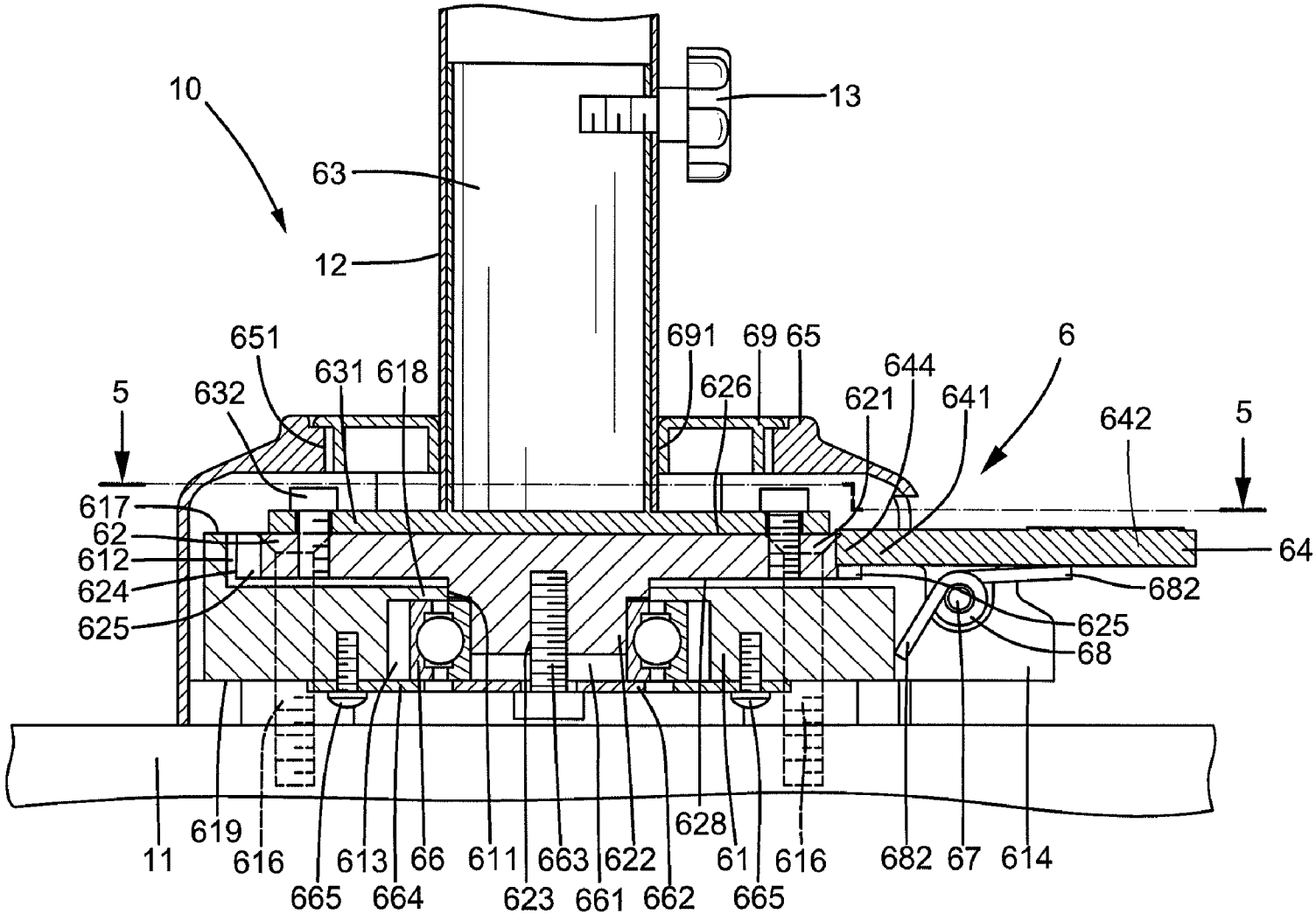
FIG. 3 shows a partial, cross sectional view of the sunshade of FIG. 1.
Figure 4:
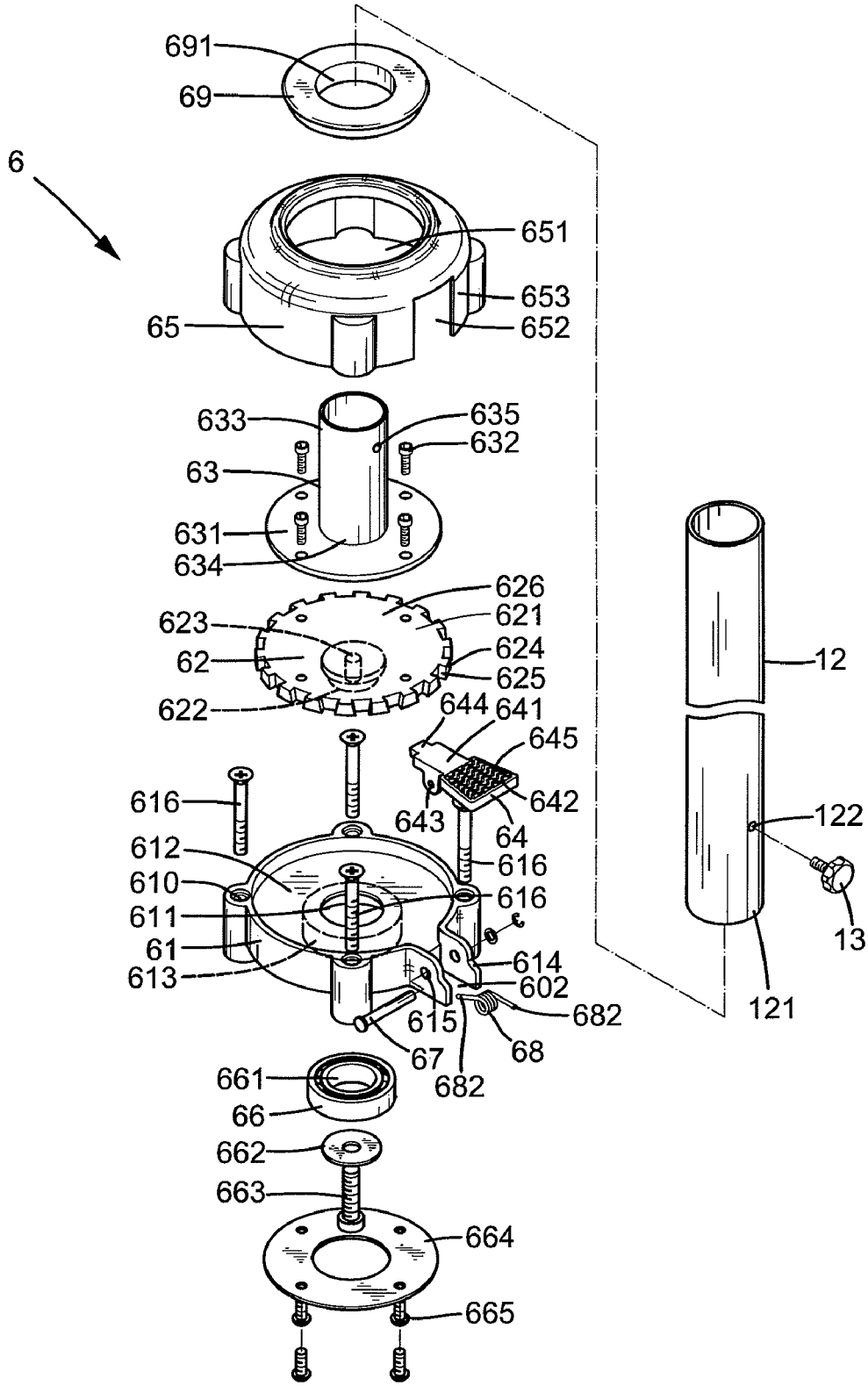
FIG. 4 shows an exploded, perspective view of components of the sunshade shown in FIG. 3.
Figure 5:
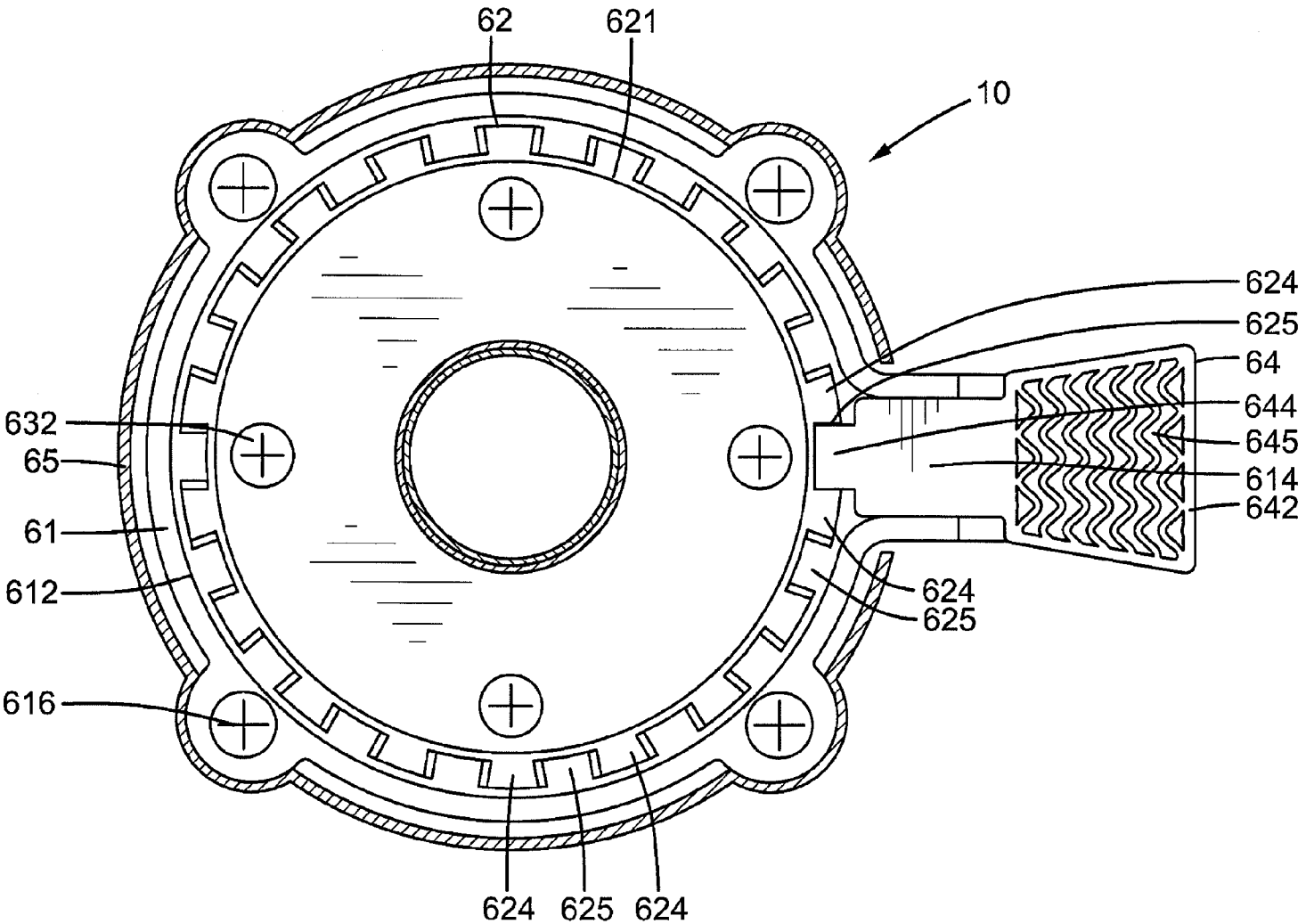
FIG. 5 shows a cross sectional view of the sunshade of FIG. 1 according to section line 5-5 of FIG. 3.
Figure 6:
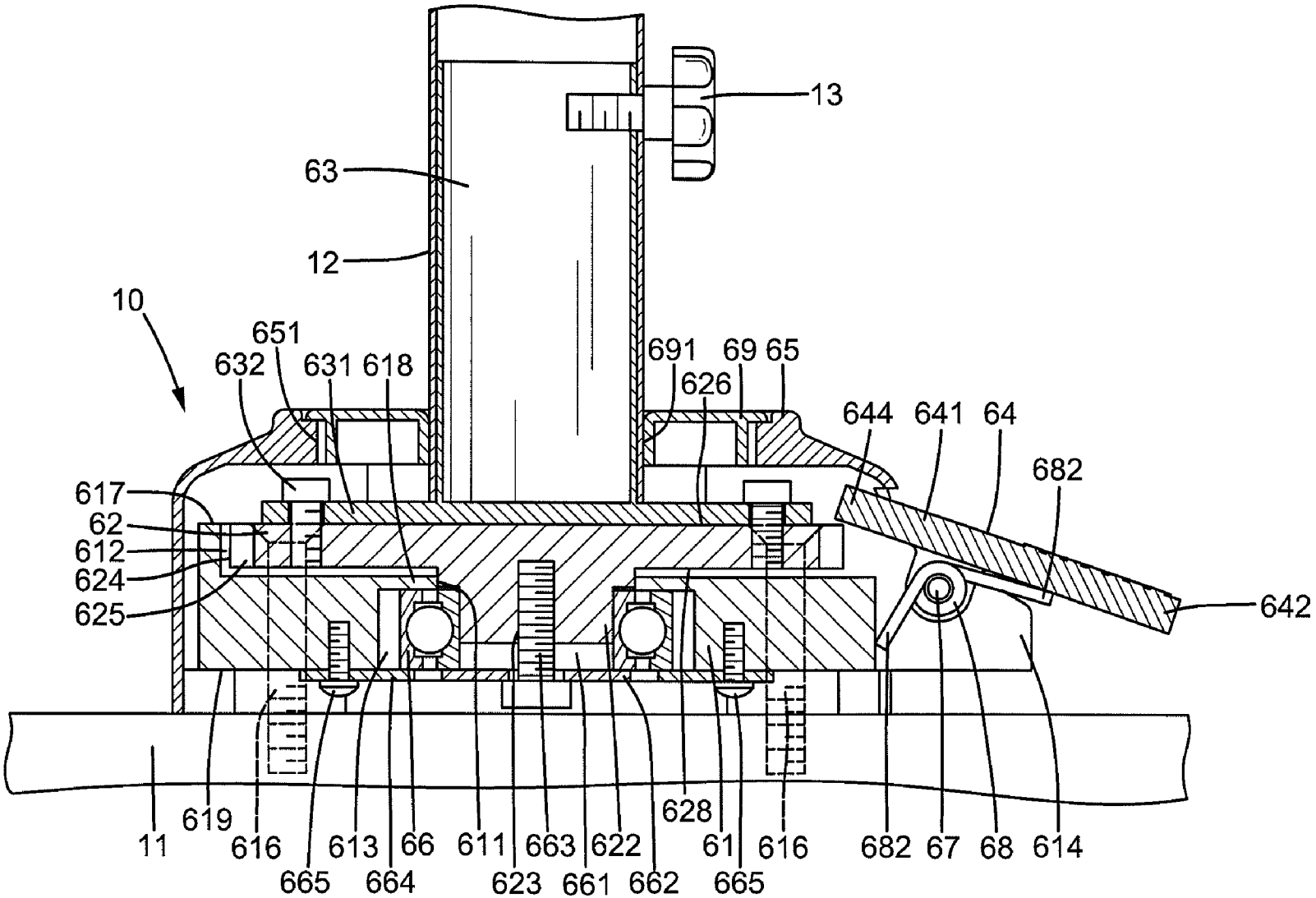
FIG. 6 shows a partial, cross sectional view of the sunshade of FIG. 1 with an operative member pressed to allow rotation of the supporting rod relative to the base.

According to the preferred form shown, adjusting device 6 further includes an operative member 64 pivotably coupled to coupling seat 61. Specifically, operative member 64 has a first end 641 pivotably received in spacing 602 between lugs 614. First end 641 of operative member 64 has a hole 643 aligned with pin holes 615 of lugs 614. Operative member 64 further includes a second end 642 outside of spacing 602 between lugs 614 and radially outwards of first end 641 of operative member 64. A pawl 644 extends from first end 641 of operative member 64 away from second end 642 of operative member 64. A pin 67 is extended through pin holes 615 of lugs 614 and hole 643 of first end 641 of operative member 64. Thus, second end 642 of operative member 64 is operable to move pawl 644 between a coupling position (FIG. 3) releasably engaged in one of positioning grooves 625 of gear 62 to fix gear 62 relative to coupling seat 61 and a release position (FIG. 6) disengaged from positioning grooves 625 so that supporting rod 12 and gear 62 are rotatable relative to base 11 to allow adjustment of an angular position of canopy 3 relative to base 11. A spring 68 is mounted around pin 67 and has two tangs 682 abutting operative member 62 and coupling seat 61 to bias pawl 644 to the coupling position. Second end 642 of operative member 64 includes an anti-slipping pattern to avoid slipping when a user steps on second end 642.

According to the preferred form shown, a cover 65 mounted around supporting rod 12 to cover coupling seat 61. Cover 65 includes an axial hole 651 extending along the vertical axis and having a diameter larger than supporting rod 12. Cover 65 further includes a skirt 653 having a notch 652 through which second end 642 of operative member 64 extends. A washer 69 is securely mounted around supporting rod 12 and rotatably received in axial hole 651 of cover 65. Washer 69 is mounted between supporting rod 12 and an inner peripheral wall of axial hole 651 to prevent dust from entering coupling seat 61. Washer 69 includes an engaging hole 691 having a diameter the same as supporting rod 12 such that washer 69 can rotate together with supporting rod 12.

Figure 2:
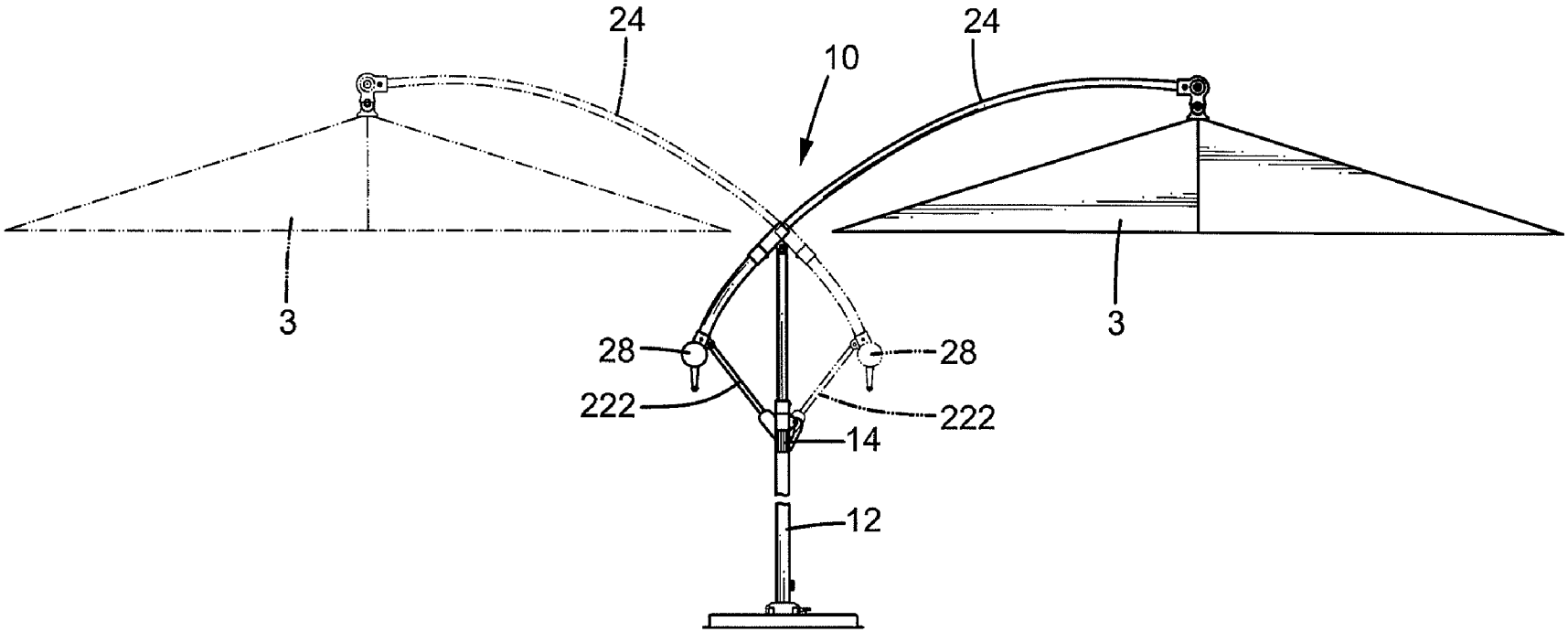
FIG. 2 shows a schematic side view of the sunshade of FIG. 1, illustrating adjustment of an angular position of a supporting rod relative to a base of the sunshade.

When it is desired to adjust the angular position of sunshade 3 relative to base 11, second end 642 of operative member 64 can be stepped on to disengage pawl 644 from positioning grooves 625 of gear 62. The user rotates supporting rod 12 to the desired angular position (FIG. 2) and then releases the operative member 64. Due to provision of hub 622 on gear 62 and bearing 66 supporting hub 622, rotation of supporting rod 12 is easy and smooth without sacrificing the structural strength for supporting rod 12. Troublesome and laborious movement of base 11 is not required. Since each positioning groove 625 of gear 62 has increasing widths toward upper face 625 of gear 62, pawl 644 of operative member 64 can easily be moved into one of the positioning grooves 625 under the action of spring 68 when operative member 64 is released.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A sunshade comprising, in combination:

a base including a top face;

a coupling seat mounted to the top face of the base;

a gear rotatably received in the coupling seat and including an outer periphery having a plurality of positioning grooves spaced in a circumferential direction;

a supporting rod fixed to the gear, with the supporting rod and the gear rotatable relative to the base about a vertical axis perpendicular to the circumferential direction, with the supporting rod adapted for supporting a canopy; and an operative member including a first end pivotably coupled to the coupling seat and a second end, with a pawl extending from the first end of the operative member, with the second end of the operative member being operable to pivot the operative member to move the pawl between a coupling position releasably engaged in one of the plurality of the positioning grooves of the gear to fix the gear relative to the coupling seat and a release position disengaged from the plurality of positioning grooves with the supporting rod and the gear rotatable relative to the base about the vertical axis, allowing adjustment of an angular position of the canopy relative to the base, with the outer periphery of the gear including a plurality of teeth, with each of the plurality of positioning grooves formed between two of the plurality of teeth adjacent to each other, with the coupling seat including first and second lugs extending outward from an outer periphery thereof, with the first and second lugs having a spacing therebetween, with the first end of the operative member pivotably received in the spacing between the first and second lugs, with the sunshade further comprising, in combination: a pin extending through the first and second lugs and the first end of the operative member; and a spring mounted around the pin and having two tangs abutting the operative member and the coupling seat to bias the pawl to the coupling position.

2. The sunshade as claimed in claim 1, with the gear including upper and lower faces spaced along the vertical axis, with a hub formed on the lower face of the gear, with the coupling seat including upper and lower surfaces spaced along the vertical axis, with the upper surface of the coupling seat including a recess rotatably receiving the gear, with the lower surface of the coupling seat including a groove separate from the recess along the vertical axis by a bottom wall, with a through-hole extending through the bottom wall and in communication with the groove and the recess, with a bearing received in the groove, and with the hub of the gear rotatably extending through the through-hole of the coupling seat into the bearing.

3. The sunshade as claimed in claim 2, with the hub including a screw hole extending along the vertical axis, with the sunshade further comprising, in combination: a washer mounted to a lower face of the bearing; and a screw extending through the washer and the bearing into the screw hole of the hub of the gear.

4. The sunshade as claimed in claim 3, further comprising, in combination: a lid mounted to the lower surface of the coupling seat to cover the groove of the coupling seat and to support the bearing.

5. The sunshade as claimed in claim 2, with the supporting rod including a first radial hole extending in a radial direction perpendicular to the vertical axis, with the sunshade further comprising, in combination: a connecting tube including upper and lower ends spaced along the vertical axis, with the upper end of the connecting tube received in the supporting rod and having a second radial hole aligned with the first radial hole, with a flange formed on the lower end of the connecting tube and fixed to the upper face of the gear; and a fastener extending through the first and second radial holes to secure the supporting rod and the connecting tube together.

6. The sunshade as claimed in claim 5, further comprising, in combination: a cover mounted around the supporting rod and covering the coupling seat, with the cover including an axial hole extending along the vertical axis and having a diameter larger than the supporting rod, with the cover including a skirt having a notch, with the operative member extending through the notch; and a washer securely mounted around the supporting rod and between the supporting rod and an inner peripheral wall of the axial hole to prevent dust from entering the coupling seat.

7. The sunshade as claimed in claim 1, with the first and second lugs spaced in a direction perpendicular to the vertical axis, with the second end of the operative member located outside of the coupling seat and outside of the spacing between the first and second lugs, and with the second end of the operative member radially outwards of the first end of the operative member.

* * * * *